US005335459A

United States Patent [19]

Dale

[11] Patent Number: 5,335,459

[45] Date of Patent: Aug. 9, 1994

[54] NOZZLE FOR ABRASIVE CLEANING OR CUTTING

[76] Inventor: Brian D. Dale, Ronda House, Terry's Lane Cookham Dene, Maidenhead; Berks, England

[21] Appl. No.: 919,842

[22] Filed: Jul. 27, 1992

[30] Foreign Application Priority Data

Jul. 27, 1991 [GB] United Kingdom ..... 9116263

[51] Int. Cl.[5] ..... B24C 5/04

[52] U.S. Cl. ..... 51/439; 51/427

[58] Field of Search ..... 51/427, 439, 319, 320, 51/321; 239/403, 405, 434.5

[56] References Cited

U.S. PATENT DOCUMENTS

| | | | |
|---|---|---|---|
| 2,001,886 | 5/1935 | Rabezzana | 51/439 |
| 2,200,587 | 5/1940 | Tirrell | 51/427 |
| 2,503,743 | 4/1950 | Keefer | 51/439 |
| 2,508,766 | 5/1950 | Morel | 51/439 |
| 2,543,517 | 2/1951 | Anderson | 51/439 |
| 3,055,149 | 9/1962 | Luce | 51/427 |
| 4,253,610 | 3/1981 | Larkin | 51/439 |
| 5,018,317 | 5/1991 | Kiyoshige et al. | 51/439 |

FOREIGN PATENT DOCUMENTS

| | | | |
|---|---|---|---|
| 192600 | 11/1907 | Fed. Rep. of Germany | 51/439 |

*Primary Examiner*—Bruce M. Kisliuk
*Assistant Examiner*—Bryan Reichenbach
*Attorney, Agent, or Firm*—John B. Sowell

[57] ABSTRACT

A mixing nozzle for producing a high velocity jet of airborne abrasive slurry comprising a cylindrical air passage of a length at least 2.5 times its diameter, a concentric circular chamber surrounding the cylindrical air passage and having a tangential entry for the abrasive slurry, and a nozzle portion having a region tapering from the diameter of the concentric circular chamber to a cylindrical region. The diameter of the cylindrical region should have a diameter lying between 1.2 and 3.0 times that of the air passage and a length at least six times its diameter. The air passage and the concentric chamber with its tangential entry is preferably formed as a replacement insert made from a wear resistant material.

11 Claims, 1 Drawing Sheet

NOZZLE FOR ABRASIVE CLEANING OR CUTTING

BACKGROUND OF THE INVENTION

1. Field of the Invention

The present invention relates to nozzles for propelling high velocity jets of airborne abrasives. More particularly the present invention relates to a novel high velocity nozzle for propelling an abrasive slurry.

2. Description of the Prior Art

Abrasive particles, such as particles of mineral slag, sand or silica carbide or similar materials carried in a jet of fluid are used for cutting or cleaning structures of metals and other materials. When the abrasive material is suspended and propelled by an air stream, a large amount of dust and particles result which is highly offensive and pose a health hazard.

To reduce the amount of airborne dust, it has been proposed to add water to the abrasive to form a slurry before introducing the abrasive material into the air stream of a nozzle. The slurry so produced is then transferred to a mixing nozzle where it is introduced into a high velocity air jet. There is a need for a highly efficient mixing nozzle for highly abrasive materials which can easily be repaired and maintained in the field.

SUMMARY OF THE INVENTION

It is an object of the present invention to provide a novel mixing nozzle for reducing the amount of airborne dust employed in cleaning or cutting nozzles.

It is another principal of the present object of the present invention to provide a novel mixing nozzle which is capable of providing a uniformly-mixed well-directed jet abrasive slurry for cleaning or cutting purposes.

It is another principal object of the present object of the present invention to provide a nozzle insert which easily removed and replaced as the principal wearing element in a novel cleaning or cutting nozzle.

In accordance with these and other objects of the present invention, there is provided a nozzle system having a cylindrical shape mixing section, a cylindrical shaped insert which fits within the mixing section, an outlet nozzle portion which holds the insert in the cylindrical shaped mixing section and an air hose adapter which couples to the inlet of the mixing section for introducing a high velocity jet of air into the insert so as to mix and blend with a slurry of abrasive material introduced into an annular cavity of the cylindrical insert and to propel the mixture from the outlet nozzle.

DETAILED DESCRIPTION OF THE PREFERRED EMBODIMENT

Figure 1:
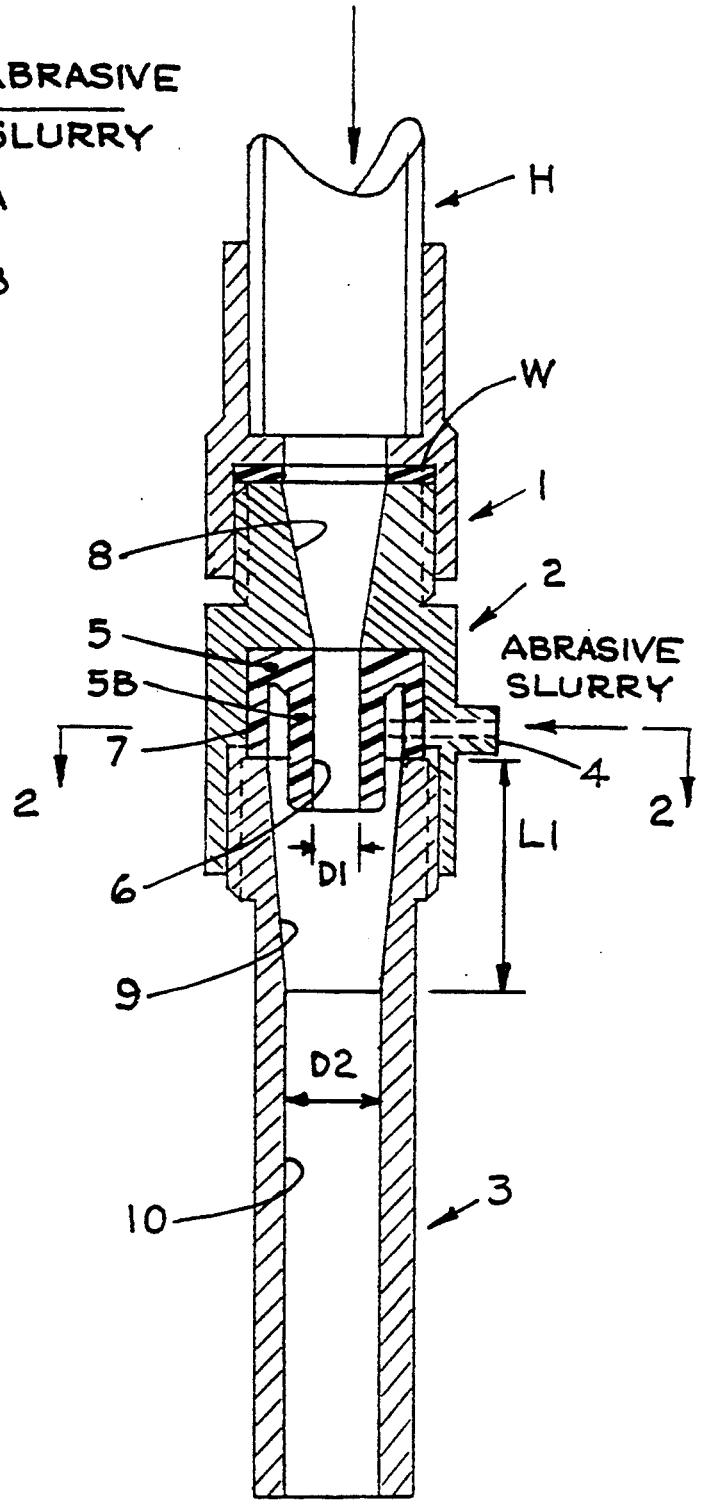
FIG. 1 is a longitudinal section taken through a preferred embodiment nozzle.

Refer now to FIG. 1 of the drawings showing a high pressure supply hose H which terminates in an adapter or fitting 1 having a female thread into which the nozzle assembly is inserted.

The nozzle assembly itself comprises two main sections or portions, a mixer section 2 which attaches directly to the air hose adapter 1 and a nozzle portion 3 which screws into the exhaust end of the mixer section 2 and holds the insert 5 in place.

Figure 2:
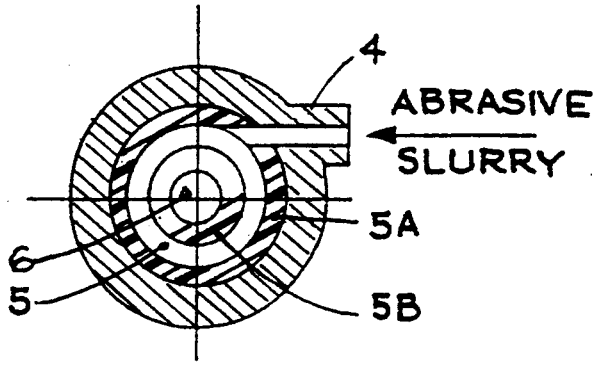
FIG. 2 is a cross-section taken on lines 2—2 of FIG. 1.

The mixer section 2 has an inlet 4 for the abrasive slurry, leading into to a cylindrical chamber within the mixer section into which is fitted an insert 5. The insert 5 which is subject to the abrasive wear, is replaceable and is preferably made from a wear-resistant material, which may range from rubber, plastics, such as cast nylon to ceramics and sintered carbides. The insert 5 comprises a central air passage or tube 6 which is surrounded by a ditch-like annular or circular chamber 7 formed by two concentric cylinders 5A and 5B. The slurry inlet 4 in mixer section 2 leads or continues tangentially into the chamber 7. This arrangement will be made more clear from FIG. 2 which is a cross-section taken through the mixing chamber and the insert 5 at the inlet 4 showing the air passage 6, slurry inlet 4 and circular chambers 7 formed by the cylindrical portions 5A and 5B.

The air supply from a high pressure hose H is coupled to air passage 6 through a smoothly tapered jet section 8 which converges and considerably increases the jet velocity of the air by the time it reaches the air passage 6 having a length L1 at least six times its diameter D1.

The nozzle portion 3 preferably screws into the exhaust end of the mixer section 2 where it seals against the outer edge of the insert 5. This portion has a tapered region 9, having a length L2 which surrounds the ends of the air passage 6 to a cylindrical region 10 forming the exit of the nozzle which has a diameter D2.

Abrasive slurry is pumped into the inlet 4 and swirls around the annular or circular chamber 7 and spills into the air stream which is emerging from the air passage 6 where it is entrained and propelled through the nozzle portion 3. The Venturi effect produced by the geometry of the air passage and the nozzle 3 assists the flow of slurry, reducing the pumping load and also helps to avoid slurry setting in the supply pipe.

To produce a compact uniform abrasive jet, certain dimensional relationships are preferred in the geometry of the present invention nozzle. The length L1 of the air passage 6 should be at least 2.5 times its diameter (D1). The internal diameter (D2) of the cylindrical region 10 of the nozzle portion 3 should lie between 1.2 and 3.0 times the air passage diameter D1. The length of the nozzle's tapered region L2 of nozzle 3 is less critical but it should not in any case exceed 16 times the internal diameter D2 of the cylindrical region 10.

Having explained a preferred embodiment of the present invention and a preferred set of ratios for the critical portions of the mixer section 2 and the nozzle portion 3, it will be understood that the tapered region 8 could well be placed in the fitting or adapter 1 as well as in the mixer section 2.

Compressible washer W is shown forming a seal between the mixer section 2 and the adapter 1 to prevent leakage of high pressure high velocity air. Similarly, a second washer W (not shown) may be employed between the insert 5 and the upper end of the nozzle 3, especially when the insert 5 is made from a brittle material such as some ceramics and sintered carbides.

What is claimed is:

1. A mixing nozzle for producing a high velocity jet of airborne abrasive slurry comprising:

a cylindrical shaped mixing section (2), a cylindrical shaped wear resistant insert (5) mounted in said mixing section having a pair of coaxial cylindrical shapes (5A,5B) spaced apart to form an open end annular chamber (7) therebetween, said cylindrical shaped insert (5) having a central cylindrical air passage (6) therethrough, said air passage having a length (L1) and a diameter (D1), wherein a ratio of the passage length to the passage diameter is at least 2.2, an abrasive slurry inlet 4) through said mixing section (2) and said insert (5) terminating into said annular chamber (7) on a substantially tangential angle, an outlet nozzle portion (3) coupled to said mixing section (2) and coaxially aligned to receive abrasive slurry directly from said annular chamber (7) of said insert (5) and to receive high velocity air through said air passage (6) of said insert (5), and an air hose adapter (1) coupled to said mixing section (2) for introducing a high velocity jet of air into said air passage (6) of said insert (2) and for propelling a high velocity mixture of abrasive slurry and air from said outlet nozzle portion (3).

2. A mixing nozzle as set forth in claim 1 wherein said nozzle portion (3) comprises a cylindrical exit portion (10) having a diameter (D2) that is 1.2 to 3.0 times the diameter (D1) of said air passage (6) of said insert (2).

3. A mixing nozzle as set forth in claim 1 which further includes a converging tapered section (8) intermediate said air hose adapter (1) and said insert (5) for increasing the velocity of said jet of air into said air passage (6).

4. A mixing nozzle as set forth in claim 1 wherein said wear resistant insert (5) is removably mounted in a cylindrical cavity of said mixing section (2) and held in place by said outlet nozzle portion (3).

5. A mixing nozzle according to claim 1 wherein said insert (5) is made from a wear resistant material selected from rubber, cast nylon plastic, ceramic or sintered carbide material.

6. A mixing nozzle according to claim 3 wherein a length (L2) of the converging tapered section (9) does not exceed sixteen times the diameter (D1) of the air passage (6).

7. A mixing nozzle for producing a jet of airborne abrasive slurry comprising a wear resistant insert having a cylindrical air passage therethrough said air passage having a length (L1) and a diameter (D1), wherein a ratio of the air passage length to the air passage diameter is at least 2.5, a concentric circular chamber in said insert surrounding the air passage and having a tangential entry into said concentric circular chamber for the abrasive slurry, said concentric circular chamber having an inner diameter and an outer diameter, and an outlet nozzle portion having an inlet region (9) tapering from the outer diameter of the concentric circular chamber to a cylindrical region (10) having a diameter (D2) lying between 1.2 and 3.0 times the diameter (D1) of the air passage and a length at least six time the diameter (D2) of the cylindrical region.

8. A mixing nozzle according to claim 7 in which a length (L2) of the inlet region does not exceed sixteen times the diameter of the cylindrical region (D2).

9. A mixing nozzle according to claim 7 having a tapering jet section between an air inlet and the air passage to increase the air velocity at the air passage.

10. A mixing nozzle according to claim 7 in which the air passage and the concentric circular chamber with the tangential slurry entry are formed as a replaceable insert.

11. A mixing nozzle according to claim 10 in which the insert is made from a material selected from wear resistant rubber, plastics, ceramic, or sintered carbide.

* * * * *